US006134094A

United States Patent [19]

Callahan et al.

[11] Patent Number: 6,134,094

[45] **Date of Patent: *Oct. 17, 2000**

[54] REMOTELY CONTROLLED ROTARY SWITCH FOR SIMULATING MULTI-POSITION, ROTARY, WAFER-TYPE, SWITCHES

[75] Inventors: Mark Arthur Callahan, Stewartstown, Pa.; Jeffrey Joseph Perloski, Freeland; Richard Michael Quintavalle, Parkton, both of Md.

[73] Assignee: AAI Corporation, Cockeysville, Md.

[ * ] Notice: This patent issued on a continued prosecution application filed under 37 CFR 1.53(d), and is subject to the twenty year patent term provisions of 35 U.S.C. 154(a)(2).

[21] Appl. No.: 09/002,083

[22] Filed: Dec. 31, 1997

[51] Int. Cl.[7] ..... H01H 47/00

[52] U.S. Cl. ..... 361/152; 307/132 R

[58] Field of Search ..... 335/125; 307/139–144, 307/132 R; 361/152, 153, 160, 167, 191, 206, 210

[56] References Cited

U.S. PATENT DOCUMENTS

| | | | |
|---|---|---|---|
| 3,002,112 | 9/1961 | Rubin . | |
| 3,688,416 | 9/1972 | Koenig et al. | 434/201 |
| 4,005,397 | 1/1977 | Blair . | |
| 4,255,733 | 3/1981 | MacLean | 335/190 |

*Primary Examiner*—Fritz Fleming
*Attorney, Agent, or Firm*—Venable; James A. Burdett; Catherine A. Ferguson

[57] ABSTRACT

The present invention employs rotary switches that can be electromechanically set or reset remotely. Typical, although not limiting, is the use of the switch of the present invention by a trainer located remotely from students' STE. Manual operation is still possible. This allows the setting of the rotary switches to an initial position prior to the trainees beginning their testing. This facilitates remote setup and thereby saves the instructor significant time in manually resetting the rotary switches.

49 Claims, 4 Drawing Sheets

| | -10 | -30 | -50 | -70 | -110 | -130 | -150 | -170 | -210 | -230 |
|---|---|---|---|---|---|---|---|---|---|---|
| #22 AWG ORG (+24V) | 13 | 13 | 13 | 13 | 13 | 13 | 13 | 13 | 13 | 13 |
| #22 AWG WHT (ROTATE LEFT) | 1 | 1 | 1 | 1 | 1 | 1 | 1 | 1 | 1 | 1 |
| #22 AWG BLK (+24VRTN) | 14 | 14 | 14 | 14 | 14 | 14 | 14 | 14 | 14 | 14 |
| #22 AWG BLK (+5VRTN) | 12 | 12 | 12 | 12 | 12 | 12 | 12 | 12 | 12 | 12 |
| #22 AWG WHT (ROTATE RIGHT) | 2 | 2 | 2 | 2 | 2 | 2 | 2 | 2 | 2 | 2 |
| #22 AWG WHT (POS. 1 SENSE 330 DEG.) | - | - | - | 4 | 6 | 7 | 7 | - | - | 6 |
| #22 AWG WHT (POS. 2 SENSE 0 DEG.) | 3 | - | 3 | 5 | - | 8 | 8 | - | - | - |
| #22 AWG WHT (POS. 3 SENSE 30 DEG.) | 4 | - | 4 | - | - | 9 | 9 | 3 | 3 | - |
| #22 AWG WHT (POS. 4 SENSE 60 DEG.) | 5 | - | 5 | - | - | 10 | 10 | 4 | 4 | - |
| #22 AWG WHT (POS. 5 SENSE 90 DEG.) | - | - | 6 | - | - | - | - | 5 | 5 | - |
| #22 AWG WHT (POS. 6 SENSE 120 DEG.) | - | 3 | 7 | - | - | - | - | 6 | 6 | - |
| #22 AWG WHT (POS. 7 SENSE 150 DEG.) | - | 4 | 8 | - | - | - | - | 7 | 7 | - |
| #22 AWG WHT (POS. 8 SENSE 180 DEG.) | - | 5 | 9 | - | - | - | - | 8 | 8 | - |
| #22 AWG WHT (POS. 9 SENSE 210 DEG.) | - | 6 | 10 | - | - | 3 | 3 | 9 | 9 | - |
| #22 AWG WHT (POS. 10 SENSE 240 DEG.) | - | - | - | - | 3 | 4 | 4 | 10 | 10 | 3 |
| #22 AWG WHT (POS. 11 SENSE 270 DEG.) | - | - | - | - | 4 | 5 | 5 | 11 | - | 4 |
| #22 AWG WHT (POS. 12 SENSE 300 DEG.) | - | - | - | 3 | 5 | 6 | 6 | - | - | 5 |

REMOTELY CONTROLLED ROTARY SWITCH FOR SIMULATING MULTI-POSITION, ROTARY, WAFER-TYPE, SWITCHES

CROSS REFERENCE TO RELATED APPLICATIONS

This application is related to the following applications: "Remotely Controlled Simulated Linear Circuit Breaker Assembly" (Ser. No. 09/002,082) by Mark Arthur Callahan, Jeffrey Joseph Perloski, Christopher Joseph Murk and John Nickolas Merkle; "Smart Test Equipment/ID Tagged Test Points" (Ser. No. 09/002,084) by Jeffrey Joseph Perloski, Paul Joseph Hoshall and Lester Louis Smith; and "Simulated Toggle Switch" (Ser. No. 09/001,689) by Mark Arthur Callahan, Jeffrey Joseph Perloski, Christopher Joseph Murk and John Nickolas Merkle and David Anthony Franckowiak, each of which is filed concurrently herewith, commonly owned, and incorporated herein by reference.

BACKGROUND OF THE INVENTION

1. Field of the Invention

The present invention relates to rotary switches and particularly to rotary switches that can be remotely, as well as manually, set and reset.

2. Statement of the Prior Art

When a student uses system test equipment (STE), the trainer must typically reset all of the rotary switches in that test equipment to a normal operating position on the simulated equipment prior to allowing the trainee to begin his or her testing Existing equipment allows detection of the switch position. However, they cannot automatically and remotely be set or reset to the desired initial position. The prior art does not contain an apparatus for automatically presetting the rotary switch position.

SUMMARY OF THE INVENTION

The present invention employs rotary switches that can be electromechanically set or reset remotely. Typical, although not limiting, is the use of the switch of the present invention by a trainer located remotely from students' STE. Manual operation is still possible. This allows the setting of the rotary switches to an initial position prior to the trainees beginning their testing. This facilitates remote setup and thereby saves the instructor significant time in manually reset ting the rotary switches.

On e object of the invention is to provide a remotely controlled rotary switch that can be set and reset in addition to manual setting and resetting of the rotary switch of the present invention.

In addition, a second object of the invention is to provide a remotely controlled rotary switch, the position of which can be remotely sensed.

Still a third object of the invention is to provide a remotely controlled rotary switch, which provides the same feel and appearance as an ordinary rotary switch, which can be manually operated.

DETAILED DESCRIPTION OF THE INVENTION

Figure 1:
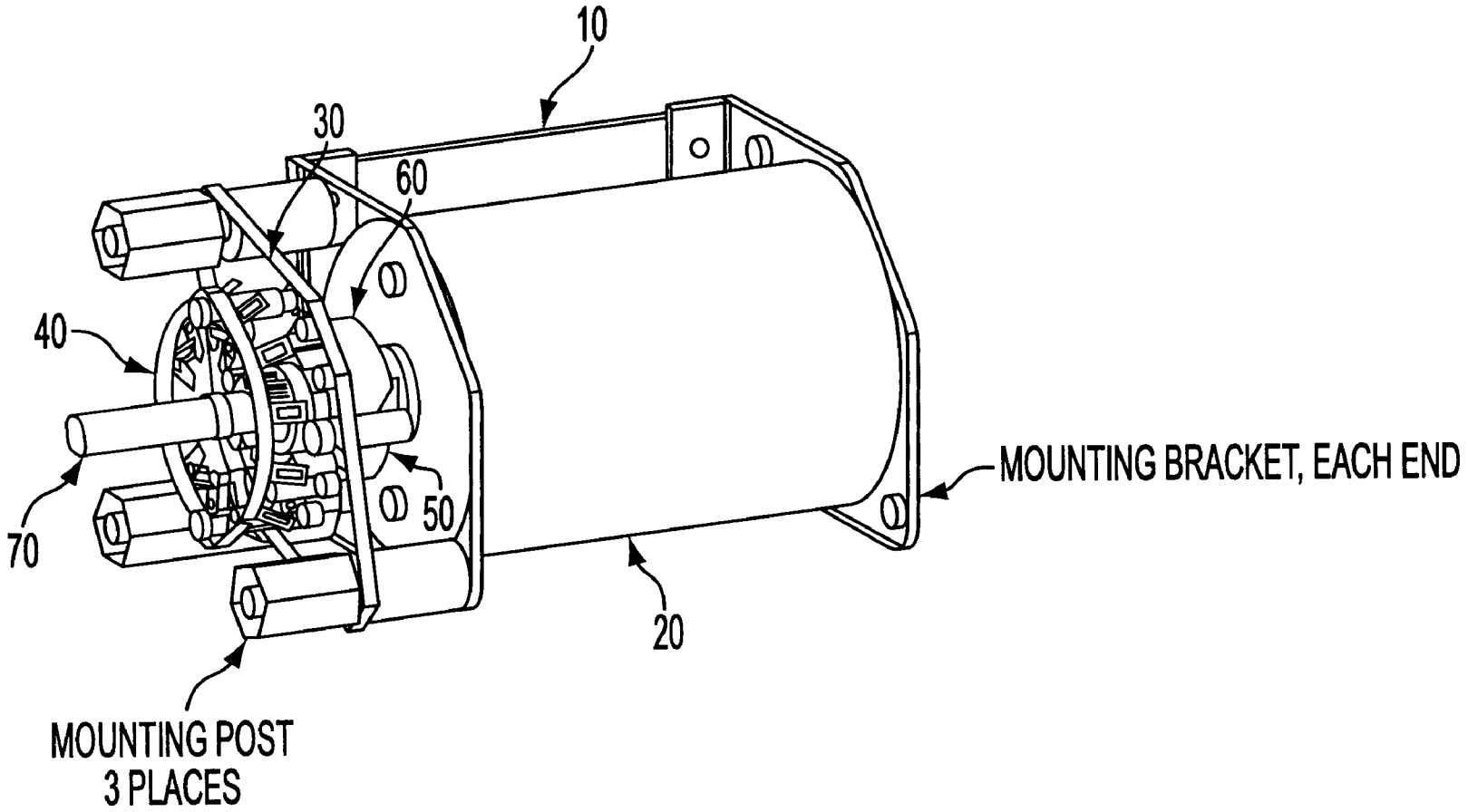
FIG. 1 is a drawing of the remotely controlled rotary switch assembly.

The remotely controlled rotary switch depicted in FIG. 1 simulates multi-position, rotary, wafer-type switches found on many types of military and commercial equipment. Basically, the device behaves as an ordinary rotary switch would in that it transmits an electrical indication of its physically rotated position. Additionally, however, its position is also electromechanically controllable by software through an interface card, denominated controller circuit card assembly 10. This controller circuit card assembly 10 controls the operation of the remotely controlled rotary switch, while providing for computer control during student training exercises.

The remotely controlled rotary switch uses a bi-directional rotary solenoid 20 that can rotate in both a clockwise and a counterclockwise direction each time the solenoid is pulsed. The bi-directional rotary solenoid is comprised of two rotary stepping solenoids (not shown) that are connected and electrically couple together. The angular rotation is 30° for each pulse.

The bi-directional rotary solenoid 20 is mounted to a twelve position indexing plate 30 that provides a mount for a twelve-position wafer switch 40 and two rotational stop pins 50. By changing the position of the stop pins on the indexing plate, the switch assembly can be configured to have from two to eleven individual switch positions. The starting and stopping position can be set at any thirty-degree increment between 0 and 360 degrees.

The rotary alignment of the wafer switch to the solenoid shaft is accomplished using a shaft extension 70 which has a collet clamping feature and a collet clamp 60 for clamping the two rotational stop pins or posts together. The second rotational stop pin or post is on the far side of the collet so is not visible on FIG. 1. The shaft extension 70 has flats machined on it to engage with the rotating disc of the wafer switch 40. The collet clamp 60 is fitted with a pin that prevents rotation of the remotely controlled rotary switch when it comes into contact with the stop pins 50 mounted on the indexing plate 30.

Figure 2:
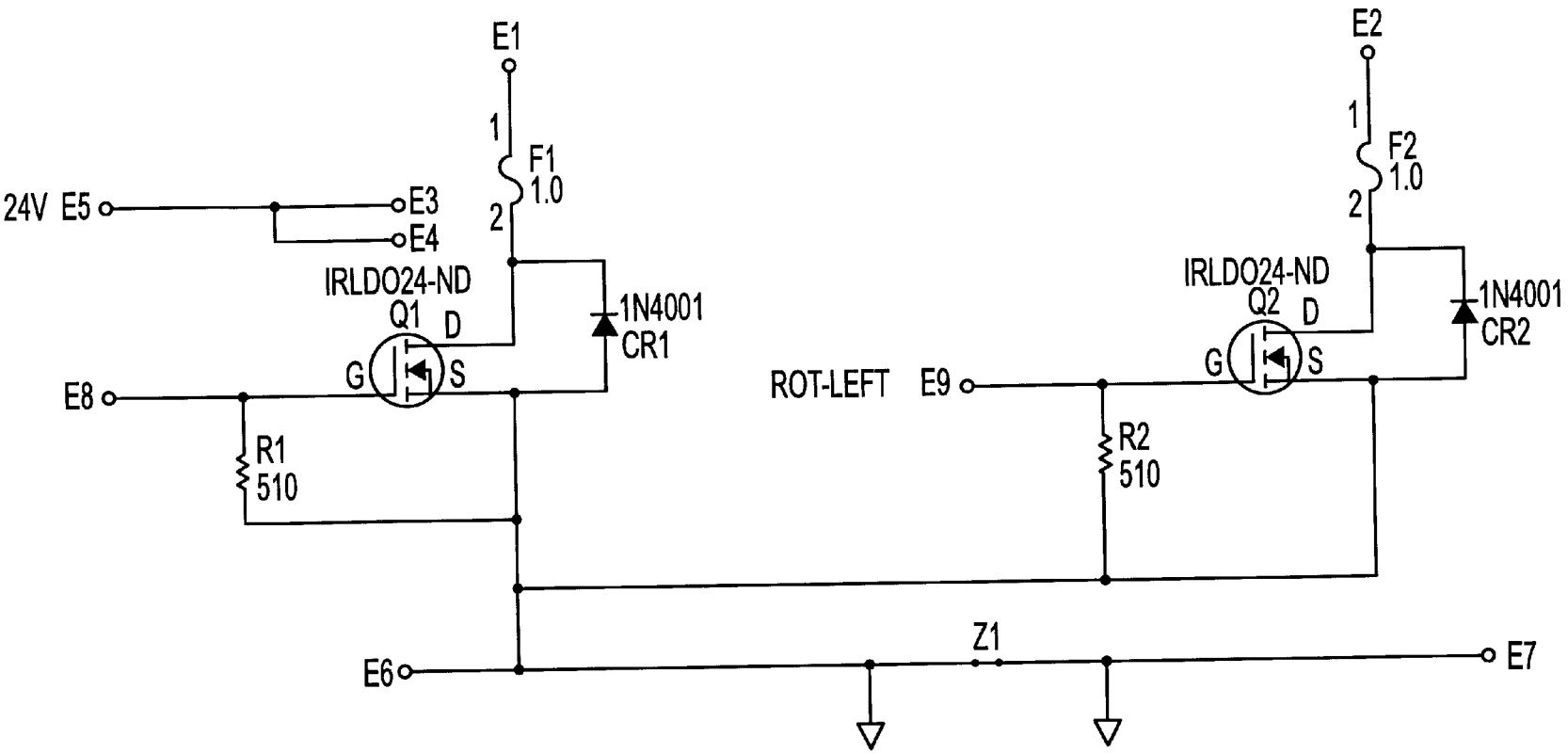
FIG. 2 is a schematic of the remotely controlled rotary switch electronic drive circuit assembly card.

Mounted to the side of the bi-directional rotary solenoid is an electronic drive circuit card assembly 10 which has its schematic depicted in detail in FIG. 2. The electronic drive circuit assembly card 10 allows computer control (remote) of the rotary switch during the student training exercises. This electronic drive circuit controls the direction of rotation of the switch by providing current flow to one of two solenoid windings. Referring to FIG. 2, the FET transistors Q1 and Q2 act as current amplifiers. When a TTL high level voltage pulse (of approximately 100 milliseconds duration) is applied to the gate of FET transistor (Q1) through printed circuit board connection E8 (a plated through-hole), the drain to source impedance of Q1 goes to a minimum value (typically less than one ohm). This condition effectively grounds one lead of the rotary solenoid winding providing current flow through the winding causing the solenoid to rotate. Similarly, FET transistor Q2 will cause solenoid rotation in the opposite direction when a TTL high level voltage pulse is applied through printed circuit board connection E9. FET transistors Q1 and Q2 are both marked with D for "drain", S for "source", and G for "gate".

The polysilicon fuses (F1 and F2) are employed for circuit protection in the event that the solenoid windings are shorted or the input pulse is too long in duration. Fuse F1 is connected and electrically coupled between the drain of the first transistor Q1 and the first lead of the bi-directional solenoid, which is connected at E1. Fuse F2 is connected and electrically coupled between the drain for the second transistor Q2 and the second lead of the bi-directional solenoid, which is connected at E2. Diodes (CR1 and CR2) serve to provide back EMF protection for transistors Q1 and Q2 from the solenoids collapsing magnetic field and the resulting voltage spike when its winding currents are switching. Diode CR1 is connected and electrically coupled between the drain and the source of the first transistor Q1. Diode CR2 is connected and electrically coupled between the drain and the source of the second transistor Q2. The input resistors (R1 and R2) bias both transistors off in the absence of an input signal and also provide for noise immunity. Resistor R1 is connected and electrically coupled between the gate and the source of the first transistor Q1. Resistor R2 is connected and electrically coupled between the gate and the source of the second transistor Q2. Plated through holes on the circuit card (E3, E4, and E5) provide a common connection for the distribution on 24 volt power. E5 provides an input connection. E3 and E4 provide 24 volt power connections to the rotary solenoid. Plated through holes E6 and E7 provide a connection for 24 volt and 5 volt power returns respectively and are tied together on the circuit card by a track connector Z1.

A TTL level control voltage pulse applied to the first input E8 of the electronic circuit card assembly causes the bi-directional solenoid to rotate right. Correspondingly, a TTL level control voltage pulse applied to the second input E9 of the electronic circuit card assembly causes the bi-directional solenoid to rotate left. The first FET transistor's (Q1) drain in connected and electrically coupled between the first lead of the bi-directional solenoid through fuse F1 at plated through-hole E1. The first FET transistor's source is connected to the rotate right plated through-hole E8. The second FET transistor's (Q2) drain in connected and electrically coupled between the second lead of the bi-directional solenoid through fuse F2 at plated through-hole E2. The second FET transistor's source is connected to the rotate left plated through-hole E9.

When a TTL level control voltage pulse is applied to the first input E8 (rotate right) of the electronic circuit card assembly, current flows from the 24 volt supply through the front solenoid's winding through the fuse (F1) into the first transistors drain (Q1) and back to the power supply through the 24 volt return.

Included at the assembly level of the remotely controlled rotary switch is a multi-position wafer switch 40 (two (2) to twelve (12) positions) that is mounted on the solenoid's output shaft. This switch has its wiper and poles wired to a connector where they are utilized to determine the position of the switch and thus the bi-directional rotary solenoid 10.

Figure 3:
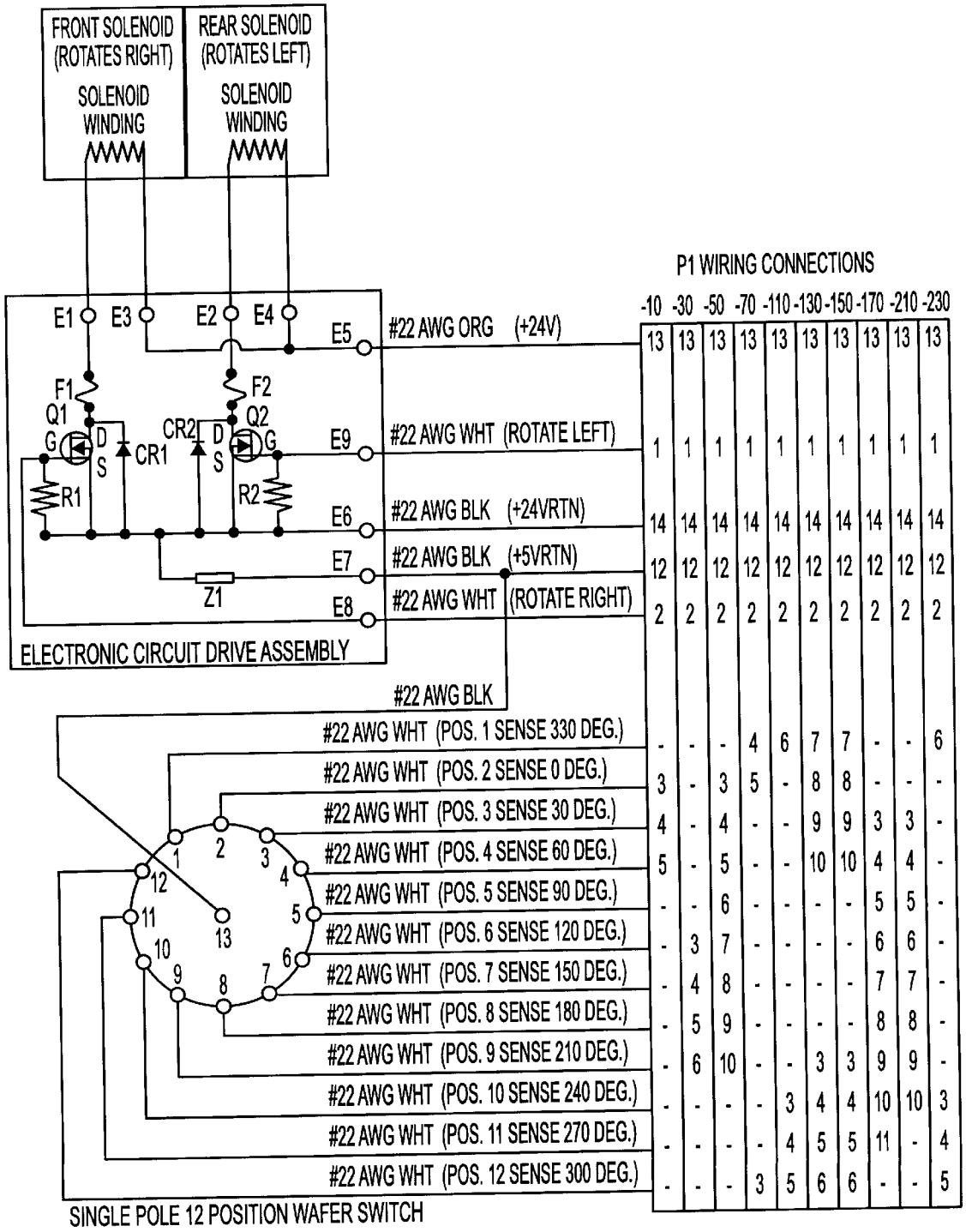
FIG. 3 is a schematic and wiring diagram of the remotely controlled rotary switch assembly.

FIG. 3 depicts the relationship between the electronic circuit card assembly 10, the bi-directional solenoid 20, the wafer switch 40 and the wiring there between. E1 through E9 are as defined above and depicted on FIG. 2. The twelve positions of the wafer switch corresponding to thirty-degree increments from 0 to 360 degrees are depicted around the perimeter of the wafer switch 40 with position 2 being 0 degrees.

Presently, there are ten variations of the remotely controlled rotary switch that are utilized in existing training systems. The wiring diagram shown in FIG. 3 depicts the ten variants which range from a three position remotely controlled rotary switch which rotates through an angular position from 0 to 60 degrees (the -10 assembly), to a nine position remotely controlled rotary switch which rotates through an angular position from 30 to 270 degrees (-170 assembly). Looking at the -10 assembly (one embodiment), connections are made to three of the twelve wafer switch positions. Pin 3 of the P1 connector is electrically connected to position 2 of the wafer switch. Pin 4 of the P1 connector is electrically connected to position 3 of the wafer switch. Pin 5 of the P1 connector is electrically connected to position 4 of the wafer switch. Therefore, it can be seen that this switch is configured to rotate through three positions or 60 degrees (the 0 degree position, the 30 degree position and the 60 degree position). Likewise, the -30 assembly (another embodiment) is configured to rotate through four positions or 90 degrees (the 120 degree position, the 150 degree position, the 180 degree position and the 210 degree position).

Connector pins 1–13 are shown in the ten columns under the heading "P1 Wiring Connections." Connector pin 13 in each of the assemblies supplies +24 volts to the electronic circuit card assembly. Connector pin 1 in each of the assemblies is the control line that commands the remotely controlled rotary switch to rotate to the left. Connector pin 2 in switch to rotate to the right. Connector pin 14 in each of the assemblies supplies the 24 volt return path to the electronic circuit card assembly. Connector pin 12 in each of the each of the assemblies is the control line that commands the remotely controlled rotary assemblies supplies the 5 volt return path to the electronic circuit card assembly and also connects to the pole of the twelve position wafer switch for purposes of determining the present position of the remotely controlled rotary switch.

Figure 4:
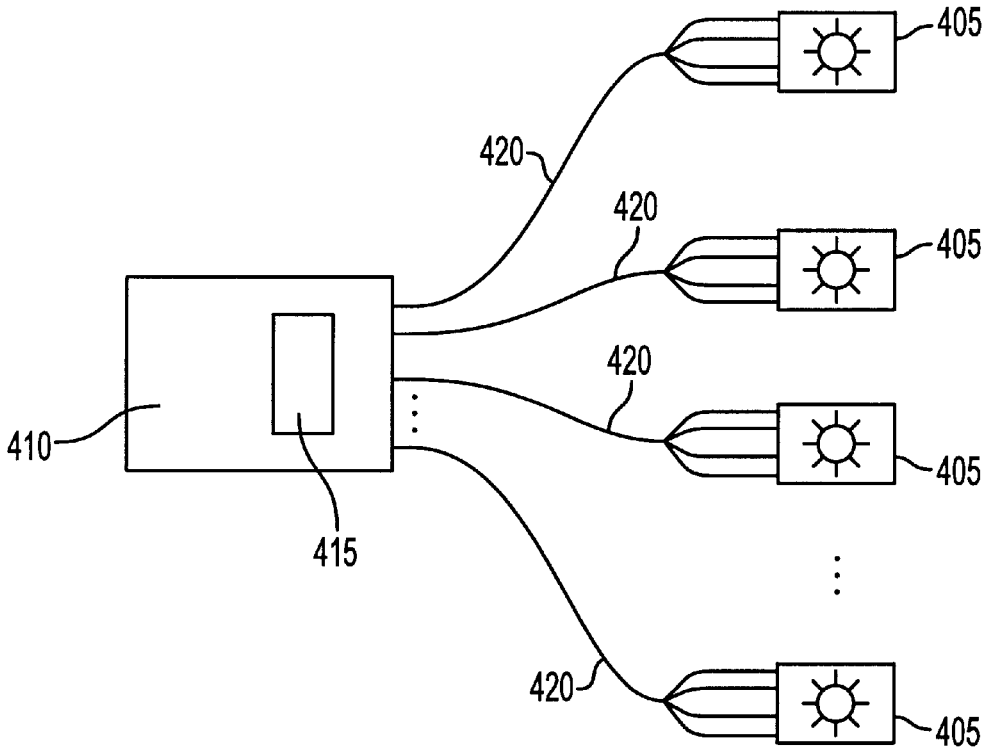
FIG. 4 illustrates a plurality of the remotely controlled rotary switches that comprise a maintenance system trainer.

FIG. 4 shows a plurality of remotely controlled rotary switches that comprise a maintenance system trainer. The trainer would control the operation of all of the remotely controlled rotary switches from his/her station. The maintenance system trainer comprises a plurality of remotely controlled rotary switches 405. Each remotely controlled rotary switch 405 is connected and electrically coupled to a control means via signal carrying means 420. The control means is a computer 410 having software 415 resident therein. The software generates control voltage pulses which control the operation of the remotely controlled rotary switch. This is accomplished when the control voltage pulses, along with 24 volt power and 24 volt and 5 volt power returns are transmitted to the electronic drive circuit card assembly of the simulated rotary switch as signals to inputs E5–E9 of the electronic drive circuit card assembly.

While the invention has been disclosed in the patent application by reference to the details of preferred embodiments of the invention, it is understood that the disclosure is intended in an illustrative, rather than a limiting sense, as it is contemplated that modifications will readily occur to those skilled in the art, within the spirit of the invention and the scope of the appended claims.

What we claim as our invention:

1. A remotely controlled rotary switch, comprising:

a bi-directional rotary solenoid having a first lead, a second lead and a shaft;

an indexing plate mounted to said solenoid;

a wafer switch mounted to said indexing plate;

at least one rotational stop pin mounted on said wafer switch;

a shaft extension connected to said solenoid and engagingly connected to said wafer switch; and an electronic drive circuit assembly having a first input and a second input, a first output connected to said first lead of said solenoid, and a second output connected to aid second lead of said solenoid, whereby when a control voltage pulse is applied to said first input of said electronic drive circuit assembly, said solenoid rotates right, and when a control voltage pulse is applied to said second input of said electronic drive circuit assembly, said solenoid rotates left.

2. The remotely controlled rotary switch according to claim 1, in which:

said shaft extension further comprises a collet clamping feature; and a collet clamp connects said shaft extension to said bi-directional rotary solenoid.

3. The remotely controlled rotary switch according to claim 2, in which said collet clamp further comprises a pin fitted in said collet clamp, whereby said collet clamp pin prevents rotation of said remotely controlled rotary switch when said collet clamp pin or post comes in contact with said rotational stop pins mounted on said indexing plate.

4. The remotely controlled rotary switch according to claim 1, in which:

said wafer switch further comprises a rotating disc; and said shaft extension has flats machined on it to engage with said rotating disc.

5. The remotely controlled rotary switch according to claim 1, in which said wafer switch is a multi-position wafer switch.

6. The remotely controlled rotary switch according to claim 5, in which said wafer switch has between 2 and 12 positions.

7. The remotely controlled rotary switch according to claim 1, in which said bi-directional rotary solenoid further comprises a plurality of stepping solenoids connected and electrically coupled together.

8. The remotely controlled rotary switch according to claim 7, in which a starting and a stopping position can be set in 30° increments.

9. The remotely controlled rotary switch according to claim 1, wherein said electronic drive circuit assembly further comprises:

a first amplifier connected and electrically coupled between said first lead of said solenoid and said first input of said electronic drive circuit assembly and a second amplifier connected and electrically coupled between said second lead of said solenoid and said second input of said electronic drive circuit assembly;

whereby when a control voltage pulse is applied to said first input of said electronic drive circuit assembly, current flows from said second amplifier through said second lead of said bi-directional solenoid to said first lead of said bi-directional solenoid, and when a control voltage pulse is applied to said second input of said electronic drive circuit assembly, current flows from said first amplifier through said first lead of said bi-directional solenoid to said second lead of said bi-directional solenoid.

10. The remotely controlled rotary switch according to claim 9, wherein said first and second amplifiers are FET transistors, each having a gate, a drain and a source.

11. The remotely controlled rotary switch according to claim 10, further comprising:

a fuse connected and electrically coupled in series between said drain of said first amplifier and said first lead of said bi-directional solenoid;

a fuse connected and electrically coupled in series between said drain of said second amplifier and said second lead of said bi-directional solenoid;

a resistor connected and electrically coupled between said gate and said source of said first amplifier;

a resistor connected and electrically coupled between said gate and said source of said second amplifier;

a diode connected and electrically coupled between said drain and said source of said first amplifier; and a diode connected and electrically coupled between said drain and said source of said second amplifier.

12. The remotely controlled rotary switch according to claim 1, further comprising:

a wiper;

at least one pole; and a connector wired to said wiper and said poles.

13. A maintenance trainer system comprising a plurality of remotely controlled rotary switches, wherein each of said remotely controlled rotary switches comprises:

a bi-directional rotary solenoid having a first lead, a second lead, and a shaft;

an indexing plate mounted to said bi-directional rotary solenoid;

a wafer switch mounted to said indexing plate;

at least one rotational stop pin mounted on said wafer switch;

a shaft extension connected and electrically coupled to said solenoid and engagingly connected to said wafer switch;

a pulse generation means; and an electronic drive circuit card assembly having a first input and a second input, a first output connected and electrically coupled to said first lead of said bi-directional rotary solenoid, and a second output connected and electrically coupled to said second lead of said bi-directional rotary solenoid, wherein said electronic drive circuit card assembly is remotely controlled by said pulse generation means, and whereby when a control voltage pulse is applied to said first input of said electronic drive circuit card assembly, said solenoid rotates right, and when a control voltage pulse is applied to said second input of said electronic drive circuit card assembly, said solenoid rotates left.

14. The maintenance trainer system according to claim 13, in which:

said shaft extension further comprises a collet clamping feature; and a collet clamp connects each of said shaft extensions to each of said corresponding bi-directional solenoids.

15. The maintenance trainer system according to claim 14, in which said each of said collet clamps further comprises a pin fitted in said collet clamp, whereby said collet clamp pin prevents rotation of said switch when said collet clamp pin comes in contact with said stop pin mounted on said indexing plate.

16. The maintenance trainer system according to claim 13, in which:

said wafer switch further comprises a rotating disc; and said shaft extension has flats machined on it to engage with each of said corresponding rotating disc.

17. The maintenance trainer system according to claim 13, in which said wafer switch is a multi-position wafer switch.

18. The maintenance trainer system according to claim 17, in which said wafer switch has between 2 and 12 positions.

19. The maintenance trainer system according to claim 13, in which said bi-directional rotary solenoid further comprises a plurality of rotary stepping solenoids coupled together.

20. The maintenance trainer system according to claim 19, in which each remotely controlled rotary switch has a starting and a stopping position can be set in 30° increments.

21. The maintenance trainer system according to claim 13, wherein each of said electronic drive circuit assemblies further comprises;

a first amplifier connected and electrically coupled between said first lead of said solenoid and said first input of said electronic drive circuit assembly and a second amplifier connected and electrically coupled between said second lead of said solenoid and said second input of said electronic drive circuit assembly;

whereby when a control voltage pulse is applied to said first input of said electronic drive circuit assembly, current flows from said second amplifier through said second lead of said bi-directional solenoid to said first lead of said bi-directional solenoid, and when a control voltage pulse is applied to said second input of said electronic drive circuit assembly, current flows from said first amplifier through said first lead of said bi-directional solenoid to said second lead of said bi-directional solenoid.

22. The maintenance trainer system according to claim 21, wherein said first and second amplifiers are FET transistors, each having a gate, a drain and a source.

23. The maintenance trainer system according to claim 22, wherein each of said remotely controlled rotary switches further comprises:

a fuse connected and electrically coupled in series between said drain of said first amplifier and said first lead of said bi-directional solenoid;

a fuse connected and electrically coupled in series between said drain of said second amplifier and said second lead of said bi-directional solenoid;

a resistor connected and electrically coupled between said gate and said source of said first amplifier;

a resistor connected and electrically coupled between said gate and said source of said second amplifier;

a diode connected and electrically coupled between said drain and said source of said first amplifier; and a diode connected and electrically coupled between said drain and said source of said second amplifier.

24. The maintenance trainer system according to claim 13, wherein each of said remotely controlled rotary switches further comprises:

a wiper;

at least one pole; and a connector wired to said wiper and said poles.

25. A remotely controlled rotary switch, comprising:

a bi-directional rotary solenoid having a first lead, a second lead and a shaft;

an indexing plate mounted to said solenoid;

a wafer switch mounted to said indexing plate;

at least one rotational stop pin mounted on said wafer switch;

a shaft extension connected to said solenoid and engagingly connected to said wafer switch; and an electronic drive circuit assembly having a first input and a second input, a first output connected to said first lead of said solenoid, and a second output connected to aid second lead of said solenoid, whereby when a control voltage pulse is applied to said first input of said electronic drive circuit assembly, said solenoid rotates right, and when a control voltage pulse is applied to said second input of said electronic drive circuit assembly, said solenoid rotates left, or in the alternative, in the absence of a control voltage pulse being applied, said bi-directional rotary switch may be operated manually.

26. The remotely controlled rotary switch according to claim 25, in which:

said shaft extension further comprises a collet clamping feature; and a collet clamp connects said shaft extension to said bi-directional rotary solenoid.

27. The remotely controlled rotary switch according to claim 26, in which said collet clamp further comprises a pin fitted in said collet clamp, whereby said collet clamp pin prevents rotation of said bi-directional rotary switch when said collet clamp pin comes in contact with said at least one rotational stop pin mounted on said indexing plate.

28. The remotely controlled rotary switch according to claim 25, in which:

said wafer switch further comprises a rotating disc; and said shaft extension has flats machined on it to engage with said rotating disc.

29. The remotely controlled rotary switch according to claim 25, in which said wafer switch is a multi-position wafer switch.

30. The remotely controlled rotary switch according to claim 29, in which said wafer switch has between 2 and 12 positions.

31. The remotely controlled rotary switch according to claim 25, in which said bi-directional rotary solenoid further comprises of a plurality of rotary stepping solenoids coupled together.

32. The remotely controlled rotary switch according to claim 31, in which a starting and a stopping position can be set in 30° increments.

33. The remotely controlled rotary switch according to claim 25, wherein said electronic drive circuit assembly further comprises:

a first amplifier connected and electrically coupled between said first lead of said solenoid and said first input of said electronic drive circuit assembly and a second amplifier connected and electrically coupled between said second lead of said solenoid and said second input of said electronic drive circuit assembly;

whereby when a control voltage pulse is applied to said first input of said electronic drive circuit assembly, current flows from said second amplifier through said second lead of said bi-directional solenoid to said first lead of said bi-directional solenoid, and when a control voltage pulse is applied to said second input of said electronic drive circuit assembly, current flows from said first amplifier through said first lead of said bi-directional solenoid to said second lead of said bi-directional solenoid.

34. The remotely controlled rotary switch according to claim 33, wherein said first and second amplifiers are FET transistors, each having a gate, a drain and a source.

35. The remotely controlled rotary switch according to claim 34, further comprising:

a fuse connected and electrically coupled in series between said drain of said first amplifier and said first lead of said bi-directional solenoid;

a fuse connected and electrically coupled in series between said drain of said second amplifier and said second lead of said bi-directional solenoid;

a resistor connected and electrically coupled between said gate and said source of said first amplifier;

a resistor connected and electrically coupled between said gate and said source of said second amplifier;

a diode connected and electrically coupled between said drain and said source of said first amplifier; and a diode connected and electrically coupled between said drain and said source of said second amplifier.

36. The remotely controlled rotary switch according to claim 25, further comprising:

a wiper;

at least one pole; and a connector wired to said wiper and said poles.

37. A maintenance trainer system comprising a plurality of remotely controlled rotary switches, wherein each of said remotely controlled rotary switches comprises:

a bi-directional rotary solenoid having a first lead, a second lead, and a shaft;

an indexing plate mounted to said bi-directional rotary solenoid;

a wafer switch mounted to said indexing plate;

at least one rotational stop pin mounted on said wafer switch;

a shaft extension connected and electrically coupled to said solenoid and engagingly connected to said wafer switch;

a pulse generation means; and an electronic drive circuit card assembly having a first input and a second input, a first output connected and electrically coupled to said first lead of said bi-directional rotary solenoid, and a second output connected and electrically coupled to said second lead of said bi-directional rotary solenoid, wherein said electronic drive circuit card assembly is remotely controlled by said pulse generation means, and whereby when a control voltage pulse is applied to said first input of said electronic drive circuit card assembly, said solenoid rotates right, and when a control voltage pulse is applied to said second input of said electronic drive circuit card assembly, said solenoid rotates left, or in the alternative, in the absence of a control voltage pulse being applied, said bi-directional rotary switch may be operated manually.

38. The maintenance trainer system according to claim 37, in which:

each of said shaft extensions further comprises a collet clamping feature; and a collet clamp connects said shaft extensions to each of said corresponding bi-directional rotary solenoids.

39. The maintenance trainer system according to claim 38, in which said each of said collet clamps further comprises a pin fitted in said collet clamp, whereby said collet clamp pin prevents rotation of said switch when said collet clamp comes in contact with said stop pin mounted on said indexing plate.

40. The maintenance trainer system according to claim 37, in which:

each of said wafer switches further comprises a rotating disc; and each of said shaft extensions has flats machined on it to engage with each of said corresponding rotating discs.

41. The maintenance trainer system according to claim 37, in which each of said wafer switches is a multi-position wafer switch.

42. The maintenance trainer system according to claim 41, in which each of said wafer switches has between 2 and 12 positions.

43. The maintenance trainer system according to claim 37, in which said bi-directional rotary solenoid further comprises of a plurality of rotary stepping solenoids coupled together.

44. The maintenance trainer system according to claim 43, in which each said remotely controlled rotary switch has a starting and a stopping position, which can be set in 30° increments.

45. The maintenance trainer system according to claim 37, wherein each of said electronic drive circuit assemblies further comprises;

a first amplifier connected and electrically coupled between said first lead of said solenoid and said first input of said electronic drive circuit assembly and a second amplifier connected and electrically coupled between said second lead of said solenoid and said second input of said electronic drive circuit assembly;

whereby when a control voltage pulse is applied to said first input of said electronic drive circuit assembly, current flows from said second amplifier through said second lead of said bi-directional solenoid to said first lead of said bi-directional solenoid, and when a control voltage pulse is applied to said second input of said electronic drive circuit assembly, current flows from said first amplifier through said first lead of said bi-directional solenoid to said second lead of said bi-directional solenoid.

46. The maintenance trainer system according to claim 45, wherein said first and second amplifiers are FET transistors, each having a gate, a drain and a source.

47. The maintenance trainer system according to claim 46, wherein each of said remotely controlled rotary switches further comprises:

a fuse connected and electrically coupled in series between said drain of said first amplifier and said first lead of said bi-directional solenoid;

a fuse connected and electrically coupled in series between said drain of said second amplifier and said second lead of said bi-directional solenoid;

a resistor connected and electrically coupled between said gate and said source of said first amplifier;

a resistor connected and electrically coupled between said gate and said source of said second amplifier;

a diode connected and electrically coupled between said drain and said source of said first amplifier; and a diode connected and electrically coupled between said drain and said source of said second amplifier.

48. The maintenance trainer system according to claim 37, wherein a wiper;

at least one pole; and a connector wired to said wiper and said poles.

49. A remotely controlled rotary switch, comprising:

a bi-directional rotary solenoid having a first lead, a second lead and a shaft;

an indexing plate mounted to said solenoid;

a wafer switch mounted to said indexing plate, said wafer switch having at least 3 positions;

at least one rotational stop pin mounted on said wafer switch;

a shaft extension connected to said solenoid and engagingly connected to said wafer switch; and an electronic drive circuit assembly having a first input and a second input, a first output connected to said first lead of said solenoid, a second output connected to said second lead of said solenoid, whereby when a control voltage pulse is applied to said first input of said electronic drive circuit assembly, said solenoid rotates right, and when a control voltage pulse is applied to said second input of said electronic drive circuit assembly, said solenoid rotates left.

* * * * *